US010217579B2

(12) United States Patent
Barnas

(10) Patent No.: US 10,217,579 B2
(45) Date of Patent: Feb. 26, 2019

(54) OPERATING MECHANISM FOR A TOGGLE SWITCH HANDLE

(71) Applicant: Eaton Intelligent Power Limited, Dublin (IE)

(72) Inventor: Jean-Christophe Barnas, Les Pontets (FR)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/771,098

(22) PCT Filed: Oct. 26, 2016

(86) PCT No.: PCT/EP2016/075833
§ 371 (c)(1),
(2) Date: Apr. 27, 2018

(87) PCT Pub. No.: WO2017/072189
PCT Pub. Date: May 4, 2017

(65) Prior Publication Data

US 2018/0330901 A1 Nov. 15, 2018

(30) Foreign Application Priority Data

Oct. 29, 2015 (GB) ..... 1519153.9

(51) Int. Cl.
*H01H 71/56* (2006.01)
*H01H 23/14* (2006.01)
*H01H 3/02* (2006.01)

(52) U.S. Cl.
CPC ..... *H01H 23/148* (2013.01); *H01H 3/022* (2013.01); *H01H 71/56* (2013.01); *H01H 2071/565* (2013.01)

(58) Field of Classification Search
CPC ..... H01H 71/1009; H01H 71/1018; H01H 71/1027; H01H 71/56; H01H 23/141; H01H 23/148; H01H 2071/565; G04F 3/06; G04F 3/02
See application file for complete search history.

(56) References Cited

U.S. PATENT DOCUMENTS 1,772,982 A * 8/1930 Brachtl ..... H01H 23/148 200/330
2,180,501 A 11/1939 Blood
3,778,633 A * 12/1973 DeVisser ..... H01H 3/264 200/50.35

(Continued)

FOREIGN PATENT DOCUMENTS

CN 202736858 U 2/2013
CN 103811235 A 5/2014

(Continued)

*Primary Examiner* — Vanessa Girardi
(74) *Attorney, Agent, or Firm* — Leydig, Voit & Mayer, Ltd.

(57) ABSTRACT

An operating mechanism for a toggle switch handle includes a bar that is movably mounted along its longitudinal axis, and a roller head mounted at one end of the bar. The roller head includes two axes for rolls. The first roll of the rolls is provided for turning on the toggle switch handle depending on a movement of the bar, and a second roll of the rolls is provided for rolling over a plate and blocking a rotation of the bar around its longitudinal axis.

7 Claims, 2 Drawing Sheets

(56) References Cited

U.S. PATENT DOCUMENTS

| | | | | | |
|---|---|---|---|---|---|
| 5,111,009 | A * | 5/1992 | Chan | H01H 3/04 | 200/330 |
| 5,397,868 | A * | 3/1995 | Smith | H01H 3/34 | 200/18 |
| 5,428,196 | A | 6/1995 | Beatty, Jr. et al. | | |
| 5,577,602 | A * | 11/1996 | Conner | H01H 23/141 | 174/66 |
| 9,431,187 | B2 * | 8/2016 | Blakeman | H01H 7/12 | |
| 2010/0163381 | A1 | 7/2010 | Schneider et al. | | |
| 2013/0146431 | A1 | 6/2013 | Smith et al. | | |

FOREIGN PATENT DOCUMENTS

| | | | |
|---|---|---|---|
| EP | 0176066 | A2 | 4/1986 |
| FR | 2609574 | A1 | 7/1988 |
| JP | S 60172121 | A | 9/1985 |
| JP | H 05307929 | A | 11/1993 |
| JP | H 1069845 | A | 3/1998 |
| JP | 2008269916 | A | 11/2008 |
| WO | WO 2007087881 | A1 | 8/2007 |

* cited by examiner

OPERATING MECHANISM FOR A TOGGLE SWITCH HANDLE

CROSS-REFERENCE TO PRIOR APPLICATIONS

This application is a U.S. National Stage Application under 35 U.S.C. § 371 of International Application No. PCT/EP2016/075833 filed on Oct. 26, 2016, and claims benefit to British Patent Application No. GB 1519153.9 filed on Oct. 29, 2015. The International Application was published in English on May 4, 2017 as WO 2017/072189 A1 under PCT Article 21(2).

FIELD

The present invention relates to an operating mechanism for a toggle switch handle, particularly of a circuit breaker. More particularly, the present invention relates to an operating mechanism for the toggle switch handle of a high current circuit breaker.

BACKGROUND

Operating mechanisms for circuit breaker handles can be used for remote operation. For example, for operating circuit breakers located in a closed cabinet, through-the-door rotary circuit breaker handles can be used. A through-the-door handle mechanism comprises an external handle, which is fixed at a cabinet's door and coupled to the circuit breakers handle by means of a bar being friction-locked on one end to the external handle and on its other end to the circuit breaker handle. Thus, the circuit breaker handle can be rotated by rotating the external handle. However, this operating mechanism is only suited for circuit breakers with rotary handles and switch mechanisms, and not for circuit breakers with toggle switch handles.

SUMMARY

In an embodiment, the present invention provides an operating mechanism for a toggle switch handle. The operating mechanism includes a bar that is movably mounted along its longitudinal axis, and a roller head mounted at one end of the bar. The roller head includes two axes for rolls. The first roll of the rolls is provided for turning on the toggle switch handle depending on a movement of the bar, and a second roll of the rolls is provided for rolling over a plate and blocking a rotation of the bar around its longitudinal axis.

BRIEF DESCRIPTION OF DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
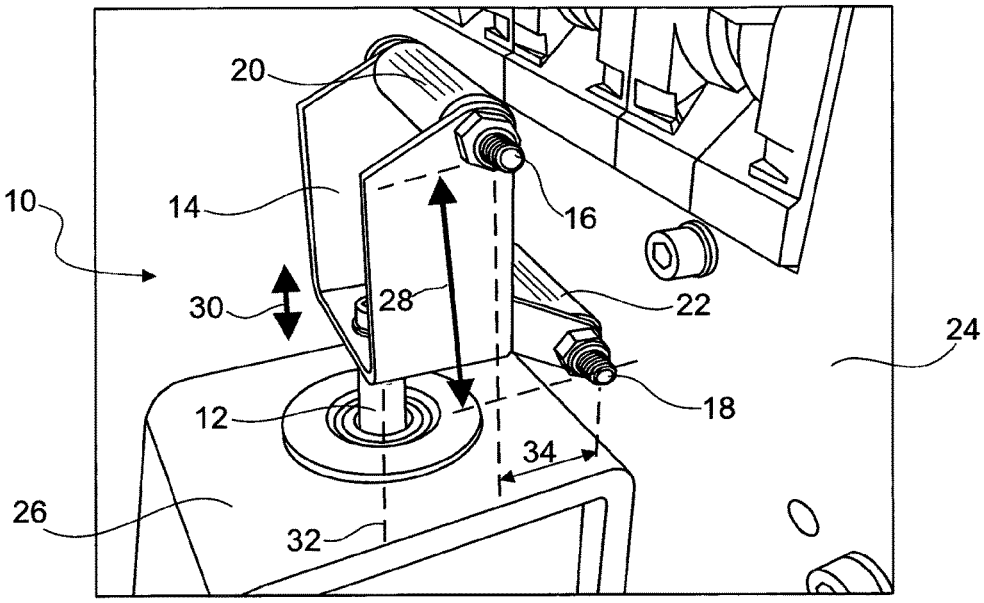
FIG. 1 shows a perspective view of an embodiment of the operating mechanism for a toggle switch handle of a circuit breaker according to the invention.

Embodiments of the present invention relate to an operating mechanism for a toggle switch handle, particularly of a circuit breaker. For example, embodiments of the present invention relate to an operating mechanism for the toggle switch handle of a high current circuit breaker.

Embodiments of the present invention use a bar having a roller head with two different rolls: a first roll is provided to operate a toggle switch handle and a second roll stabilizes the mechanism comprising the bar and the roller head with rolls so that a rotation of the bar around its longitudinal axis is blocked. The roller head design has two advantages: it allows reducing the forces applied to the toggle switch handle due to the rotating first roll, which "rolls over" the toggle switch handle when the bar with the roller head is moved. Thus, the forces of the pushing bar are converted into rotational forces on the toggle switch handle. Furthermore, the second roll stabilizes the movement of the bar with the roller head and, thus, improves the equilibrium of the entire mechanism. The inventive mechanism is particularly suitable for resetting toggle switch handles of circuit breakers, especially high current circuit breaker such as of the Heinemann circuit breakers series GJ from Eaton Corporation, USA, or similar circuit breakers from other manufacturers.

An embodiment of the invention relates to a an operating mechanism for a toggle switch handle comprising a bar being movably mounted along its longitudinal axis, and a roller head mounted at one end of the bar and comprising two axes for rolls, wherein a first roll is provided for turning on the toggle switch handle depending on a movement of the bar and a second roll is provided for rolling over a plate and blocking a rotation of the bar around its longitudinal axis.

The two axes for the rolls may be displaced in the direction of movement of the bar such that the first roll is located ahead of the second roll.

The radial distances of the first and second roll from the bar's axis may differ such that the first roll has a distance from the plate on which the second roll rests, which essentially corresponds to height of the toggle switch handle. Particularly, the distance from the plate on which the second roll rests may be selected such that the first roll turns on the lower part of the toggle switch handle.

The roller head may be u-shaped with the axis for the first roll being mounted between the clamps ends.

The mechanism may comprise an electromagnetic drive and/or an air pressure based drive for moving the bar along its longitudinal axis.

A further embodiment of the invention relates to a circuit breaker comprising a toggle switch handle and a mechanism of the invention and as described herein for operating the toggle switch handle, wherein the toggle switch handle and the mechanism are mounted on a plate such that the second roll of the mechanism rolls over the plate and the first roll turns on the toggle switch handle upon movement of the bar of the mechanism.

These and other aspects of the invention will be apparent from and elucidated with reference to the embodiments described hereinafter.

In the following, functionally similar or identical elements may have the same reference numerals. Absolute values are shown below by way of example only and should not be construed as limiting the invention.

FIG. 1 shows an operating mechanism 10 for the toggle switch handle 36 (FIG. 2, 3) of a circuit breaker. The circuit breaker is mounted behind a plate 24, on which an electromagnet drive 26 of the mechanism is fixed. The electromagnet drive 26 comprises an electromagnet for moving a bar 12 mounted in the drive 26 along its longitudinal axis 32 as shown by the double arrow 30.

Figure 2:
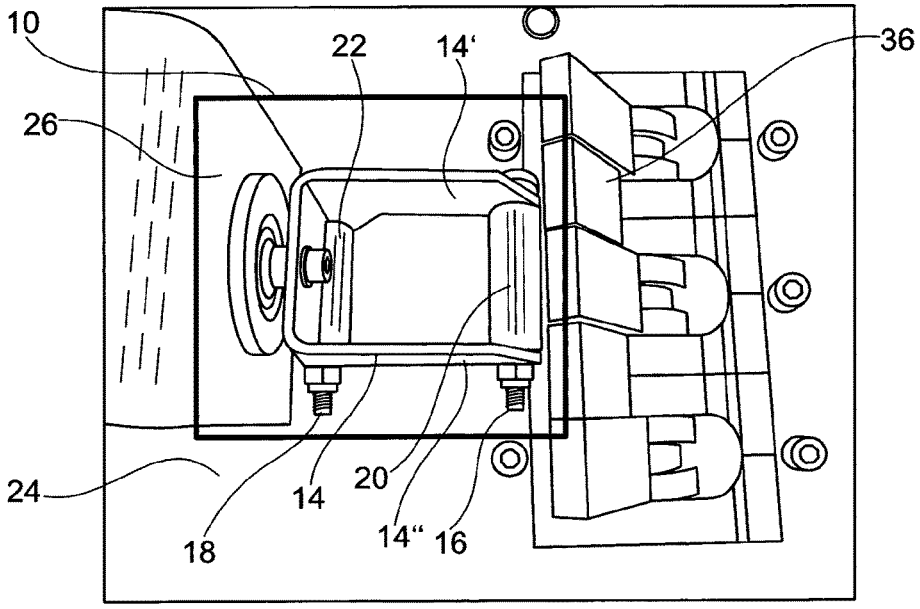
FIG. 2 shows a top view on the mechanism of FIG. 1 with the roller head being in a first position.
Figure 3:
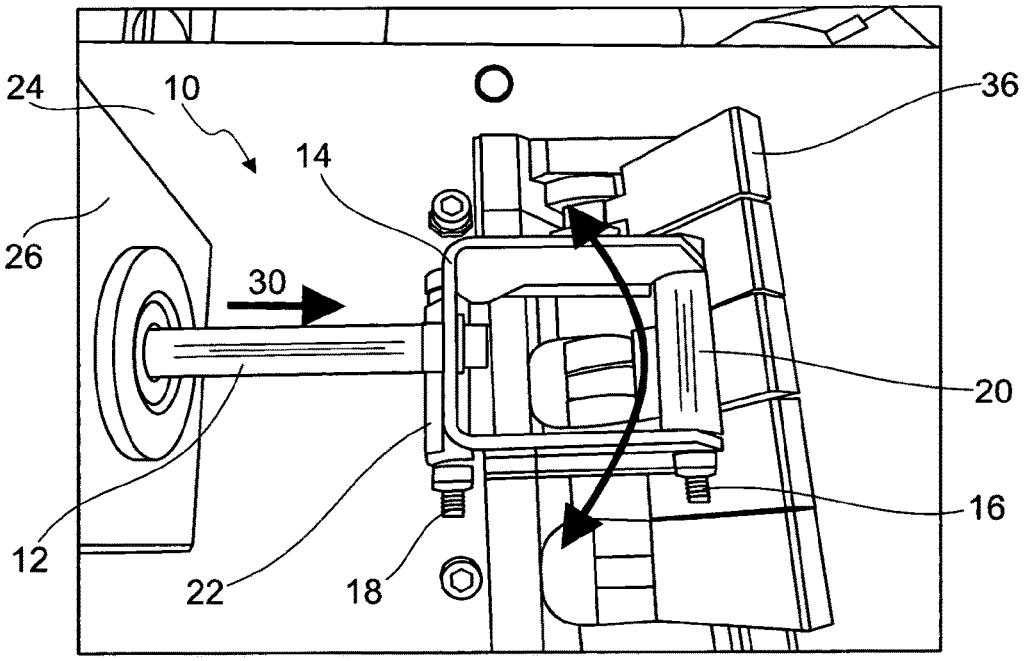
FIG. 3 shows a top view on the mechanism of FIG. 1 with the roller head being in a second position.

A roller head 14 is mounted at the bar's 12 end resting outside the drive 26, namely fixed by a screw on the bar 12. The roller head 14 is u-shaped, as shown in FIGS. 2 and 3. The roller head 14 serves as carrier for two rolls 20 and 22. The first roll 20 is rotatable (rotatably mounted) on a first axis 16, which is mounted between the ends of both clamps 14' and 14" of the head 14 (FIG. 2). The second roll 22 is rotatable (rotatably mounted) on a second axis 18, which is mounted between the ends of two levers extending from the roller head 14 to the plate 24.

The first axis 16 and the second axis 18 are displaced in the direction of movement of the bar 12 (displacement 28). By the displacement 28, the first roll 20 is placed ahead of the second roll 22 so that the first roll 20.

The radial distance of the second axis 18 from the axis 32 is selected such that the second roll 22 rests on the plate 24 and rolls over the plate 24 upon a movement of the bar 12. The radial distance of the first axis 16 from the axis 32 is smaller than the radial distance of the second axis 18 and depends on the toggle switch handle. In fact, the radial distance of the first axis 16 is selected such that the distance 34 of the axis 16 and roll 20 from the plate 24 corresponds to the height of the toggle switch handle. Thus, when the bar 12 is moved by the electromagnet drive 26 the second roll 22 rolls over the plate 24 and the first roll 20 over the toggle switch handle. A rotation of the bar 12 around its longitudinal axis is blocked by the second roll 22 and the forces acting on the toggle switch handle are reduced by the first roll 20 smoothly rolling of at least a part of the toggle switch handle.

FIG. 2 shows in a top view the mechanism 10 in conjunction with the toggle switch handle 36 of a high current circuit breaker mounted behind the plate 24. The roller head 14 is in a first position with the bar retracted in the magnet of electromagnetic drive 26. In this first position, the second roll 22 is placed near the drive 26 and the first roll 20 is placed before the toggle switch handle 36.

FIG. 3 shows the roller head 14 brought in a second position, where the first roll 20 is rolled over the toggle switch handle 36 and the second roll 22 placed near the toggle switch handle 36. In this second position, the bar 12 is moved out of the magnet of the electromagnet drive 26 as shown by arrow 30. The second roll 22 rests on the plate 24 and blocks any rotation of the bar 12 around its longitudinal axis, thus stabilizing the roller head 14.

It should be noted that the roller head 14 can be adapted to different toggle switch handles by selecting suitable displacements of the rolls 20 and 22 in the direction 30 of movement of the bar 12 and roller head 14 and in radial direction. For example, the distance of the first roll 20 from the plate 24 can be selected such that the first roll 20 turns on a specific part of the toggle switch handle, particularly the lower part of the handle in order securely operate the handle.

The rolls 20 and 22 can be made of plastic, while the other parts of the roller head 14 and the bar 12 can made of a metal in order to stand higher strains for example when used on toggle switch handles of larger circuit breakers, which require large switching forces.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. An operating mechanism for a toggle switch handle comprising:

a bar movably mounted along its longitudinal axis, and a roller head mounted at one end of the bar and comprising two axes for rolls, wherein a first roll of the rolls is provided for turning on the toggle switch handle depending on a movement of the bar and a second roll of the rolls is provided for rolling over a plate and blocking a rotation of the bar around its longitudinal axis.

2. The operating mechanism of claim 1, wherein the two axes for the rolls are displaced in the direction of movement of the bar such that the first roll is located ahead of the second roll.

3. The operating mechanism of claim 1, wherein the roller head is u-shaped with a first axis of the two axes, which is for the first roll, being mounted between clamp ends of the roller head.

4. The operating mechanism of claim 1, comprising an electromagnetic drive and/or an air pressure based drive for moving the bar along the bar's longitudinal axis.

5. A circuit breaker comprising the toggle switch handle and the operating mechanism of claim 1 for operating the toggle switch handle, wherein the toggle switch handle and the mechanism are mounted on the plate such that the second roll of the mechanism rolls over the plate and the first roll turns on the toggle switch handle upon movement of the bar of the mechanism.

6. The operating mechanism of claim 1, wherein radial distances of the first roll and the second roll from the bar's longitudinal axis differ such that the first roll is configured to have a distance from the plate on which the second roll is configured to rest, which corresponds to a height of the toggle switch handle.

7. The operating mechanism of claim 6, wherein the distance from the plate on which the second roll is configured to rest is selected such that the first roll turns on a lower part of the toggle switch handle in an operational state.

* * * * *